US008205412B2

(12) United States Patent
Williams et al.

(10) Patent No.: US 8,205,412 B2
(45) Date of Patent: Jun. 26, 2012

(54) PANELIZATION METHOD AND SYSTEM

(75) Inventors: Martin Williams, Phoenix, MD (US); Bill R. Lindley, II, Edmond, OK (US); Brian Jacob Meyer, Columbia, SC (US)

(73) Assignees: Consolidated Systems, Inc., Columbia, SC (US); W&W Steel, LLC, Oklahoma City, OK (US)

( * ) Notice: Subject to any disclaimer, the term of this patent is extended or adjusted under 35 U.S.C. 154(b) by 920 days.

(21) Appl. No.: 12/019,138

(22) Filed: Jan. 24, 2008

(65) Prior Publication Data

US 2009/0188191 A1 Jul. 30, 2009

(51) Int. Cl.
*E04B 1/00* (2006.01)

(52) U.S. Cl. ..... 52/745.2; 52/414; 52/263; 52/340

(58) Field of Classification Search ..... 52/263, 52/262, 414, 459, 460, 461, 470, 471, 472, 52/320, 321, 322, 323, 325, 261, 264, 283, 52/319, 340, 335, 336, 745.05, 745.19, 745.2
See application file for complete search history.

(56) References Cited

U.S. PATENT DOCUMENTS 915,421 A * 3/1909 Eisen ..... 52/236.9
938,458 A * 11/1909 Brookhausen ..... 52/283
980,480 A * 1/1911 Bishop ..... 52/745.17
1,354,560 A * 10/1920 Hutchinson ..... 52/777
1,376,152 A * 4/1921 Moore ..... 52/259
1,380,324 A * 5/1921 Piggins ..... 52/283
1,516,074 A * 11/1924 Borg ..... 52/236.9
2,338,246 A * 1/1944 Hoge ..... 52/601
3,110,982 A * 11/1963 Besinger ..... 52/301
3,378,971 A * 4/1968 Singer et al. ..... 52/263
3,429,092 A * 2/1969 Hart et al. ..... 52/653.1
3,495,371 A * 2/1970 Mitchell, Jr. ..... 52/653.1
3,708,933 A * 1/1973 Yang ..... 52/236.4
3,713,265 A * 1/1973 Wysocki et al. ..... 52/745.14
3,867,805 A * 2/1975 Mikami et al. ..... 52/742.15
3,956,864 A * 5/1976 Fung ..... 52/414
3,967,426 A * 7/1976 Ault et al. ..... 52/252
4,081,935 A * 4/1978 Wise ..... 52/236.8
4,211,045 A * 7/1980 Koizumi et al. ..... 52/251
4,333,285 A * 6/1982 Koizumi et al. ..... 52/252
4,443,985 A * 4/1984 Moreno ..... 52/236.8
4,575,984 A * 3/1986 Versteeg ..... 52/591.2
4,597,233 A * 7/1986 Rongoe, Jr. ..... 52/334
4,685,264 A * 8/1987 Landis ..... 52/252
4,768,938 A * 9/1988 Greeson ..... 425/62
4,845,908 A * 7/1989 Stohs ..... 174/486
4,951,438 A * 8/1990 Thoresen ..... 52/252
4,972,537 A * 11/1990 Slaw, Sr. ..... 14/77.1
5,050,358 A * 9/1991 Vladislavic ..... 52/334
5,253,460 A * 10/1993 Simenoff ..... 52/252
5,444,957 A * 8/1995 Roberts ..... 52/745.05
5,640,814 A * 6/1997 Godfrey ..... 52/143

(Continued)

*Primary Examiner* — William Gilbert
*Assistant Examiner* — James Ference
(74) *Attorney, Agent, or Firm* — Michael A. Mann; Nexsen Pruet, LLC

(57) ABSTRACT

A prefabrication system having a floor component and a frame component. In particular, the floor component includes a deck member, which can be made of deck sections, profiles, or panels. For example, the deck member can be made of continuous panels that cover the desired width and length of the floor component. Alternatively, the deck member can be made of preassembled sections that are combined in juxtaposed relation to form the desired width and length. The frame component includes opposing horizontal support channels that are attached to opposing vertical columns, respectfully.

16 Claims, 16 Drawing Sheets

U.S. PATENT DOCUMENTS

| | | | | | |
|---|---|---|---|---|---|
| 5,682,717 | A | * | 11/1997 | Carranza-Aubry | 52/251 |
| 5,704,174 | A | * | 1/1998 | Dal Lago | 52/220.5 |
| 5,704,181 | A | * | 1/1998 | Fisher et al. | 52/438 |
| 5,809,724 | A | * | 9/1998 | Bodnar | 52/414 |
| 5,845,457 | A | * | 12/1998 | Wybauw | 52/745.2 |
| 5,887,405 | A | * | 3/1999 | Carranza-Aubry | 52/745.1 |
| 5,941,035 | A | * | 8/1999 | Purse | 52/263 |
| 5,978,997 | A | * | 11/1999 | Grossman | 14/73 |
| 6,076,311 | A | * | 6/2000 | Godfrey | 52/143 |
| 6,101,779 | A | * | 8/2000 | Davenport | 52/602 |
| 6,543,195 | B2 | | 4/2003 | Rahimzadeh | |
| 6,698,148 | B1 | * | 3/2004 | Manna et al. | 52/302.1 |
| 7,028,435 | B2 | * | 4/2006 | Walker et al. | 52/236.5 |
| 7,360,343 | B1 | * | 4/2008 | Spransy et al. | 52/263 |
| 7,389,620 | B1 | * | 6/2008 | McManus | 52/414 |
| 7,571,580 | B2 | * | 8/2009 | Miller | 52/650.3 |
| 7,600,283 | B2 | * | 10/2009 | Nelson | 14/77.1 |
| 7,845,138 | B2 | * | 12/2010 | Groothuis | 52/742.1 |
| 2003/0093961 | A1 | * | 5/2003 | Grossman | 52/250 |
| 2003/0097806 | A1 | * | 5/2003 | Brown | 52/220.1 |
| 2005/0011148 | A1 | * | 1/2005 | Hwang et al. | 52/263 |
| 2007/0175132 | A1 | * | 8/2007 | Spransy et al. | 52/263 |
| 2008/0295427 | A1 | * | 12/2008 | Termohlen | 52/263 |

* cited by examiner

PANELIZATION METHOD AND SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

The present invention relates generally to prefabrication systems, and, more particularly, to systems employing prefabricated planks and frames.

A major concern in building construction is minimizing costs, maintaining a safe working environment and maximizing architectural flexibility and creativity. Striking this balance is the greatest challenge faced in developing prefabrication systems. Thus far, prefabrication systems have lacked in quality because of the need to reduce the costs of the materials employed, as costs for non-standard parts, as well as labor costs for the mounting and finishing steps, tend to be very high.

Additionally, prior prefabrication systems require repetitive structural elements, which leave no space for the introduction of personalized elements during the design stage of the building. The installation difficulties faced with prefabrication systems have further contributed to the use of inflexible, repetitive components.

Assuring worker safety is a paramount concern during the construction phase of any building, particularly high-rise structures. The installation of prefabricated floor modules, as opposed to traditional stick built methods, promotes job-site safety. The assemblage of components takes place at ground level assuring that less labor is required at elevated levels. Additionally, once the modules are in-place, workers of all trades are provided an immediate platform over which they can perform their activities.

Accordingly, there exists a need for an improved prefabrication system that provides convenient, flexible components that are easily preassembled and installed.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention includes a prefabrication system having a floor component and a frame component. In particular, the floor component includes a deck member, which can be made of deck sections, profiles, or panels. For example, the deck member can be made of continuous panels that cover the desired width and length of the floor component. Alternatively, the deck member can be made of sections that are combined in juxtaposed relation to form the desired width and length. The frame component, which is generally rectangular shaped, includes horizontal support beam elements on three sides and a spandrel beam on the fourth side that are attached to opposing vertical columns, respectfully. The beam elements are not limited to a shape, and can be generally C or I-shaped, and include a top flange that is dimensioned to support each end of the deck member. Additionally, multiple floor and frame components can be combined to form a building having multiple rooms and levels.

The present invention further includes a method for constructing a floor using the panelization system. The steps of the method include: 1) providing vertical columns that are spaced apart so as to establish panelization system perimeters in a building construction or any particular area within a building construction; 2) providing a horizontal framing system; 3) providing a composite decking system; 4) connecting the horizontal framing system and the composite decking system to form a panelization system; 5) elevating the panelization system and positioning the panelization system between the vertical columns; 6) connecting the panelization system to the vertical columns; and 7) forming a spandrel beam system that is connected to the panelization system.

A feature of the present invention is the use of a framing system that employs the use of beam elements that are connected to vertical columns. Traditional framing systems use I-beams that span between the centerline of vertical columns to provide support for floor components. These typical framing systems impede the space for mechanical openings between the columns. By using beam elements that are connected to either side of a four-sided column, a space is created between the beam elements at the centerline of the vertical columns. This space can then be used to create flexibility in design options. As an example, the space creates open areas through the floor system for mechanical equipment items such as piping, air supply ducts, and conduit.

Another feature of the present invention is the use of a spandrel beam that maintains the depth of the floor. In steel or concrete construction, the exterior beam that extends from column to column and marks the floor level between stories is commonly referred to as a spandrel beam. Spandrel beams are employed to support non-load bearing exterior fascia elements. Spandrel beams can also support floor loads; however, this application requires additional reinforcement. Traditionally, the challenge has been in providing reinforcement to the spandrel beam without increasing the depth of the slab, thus eliminating the need for a dropped beam, which is not aesthetically pleasing. The spandrel beam of the present invention is flush with the flooring of a building. Accordingly, the spandrel system accomplishes the challenging task of supporting an exterior curtain wall, while still providing an uninterrupted ceiling at the curtain wall.

Yet another feature of the present invention is the method for constructing a floor using the panelization system. Traditional methods for construction require that individual banded bundles of floor components be lifted onto horizontal beams. The bundles are then unbanded, and individual floor component pieces are distributed over the beams elements. The individual floor components are attached to the beam elements to complete the installation. This process becomes increasingly challenging, creating additional safety issues, thus adding expense to the construction of multi-story buildings. The present invention, however, provides for the positioning of a panelization system including preassembled floor components between the vertical columns at the desired floor elevations. Accordingly, the maneuvering and installation of individual floor components is avoided. The panelization system, when installed, gives construction workers immediate access to a large load supporting platform, thereby promoting construction safety.

Other features and advantages of the present invention will be apparent to those skilled in the art from a careful reading of the Detailed Disclosure of the Preferred Embodiment presented below and accompanied by the drawings.

DETAILED DESCRIPTION OF THE PREFERRED EMBODIMENT

Figure 1A:
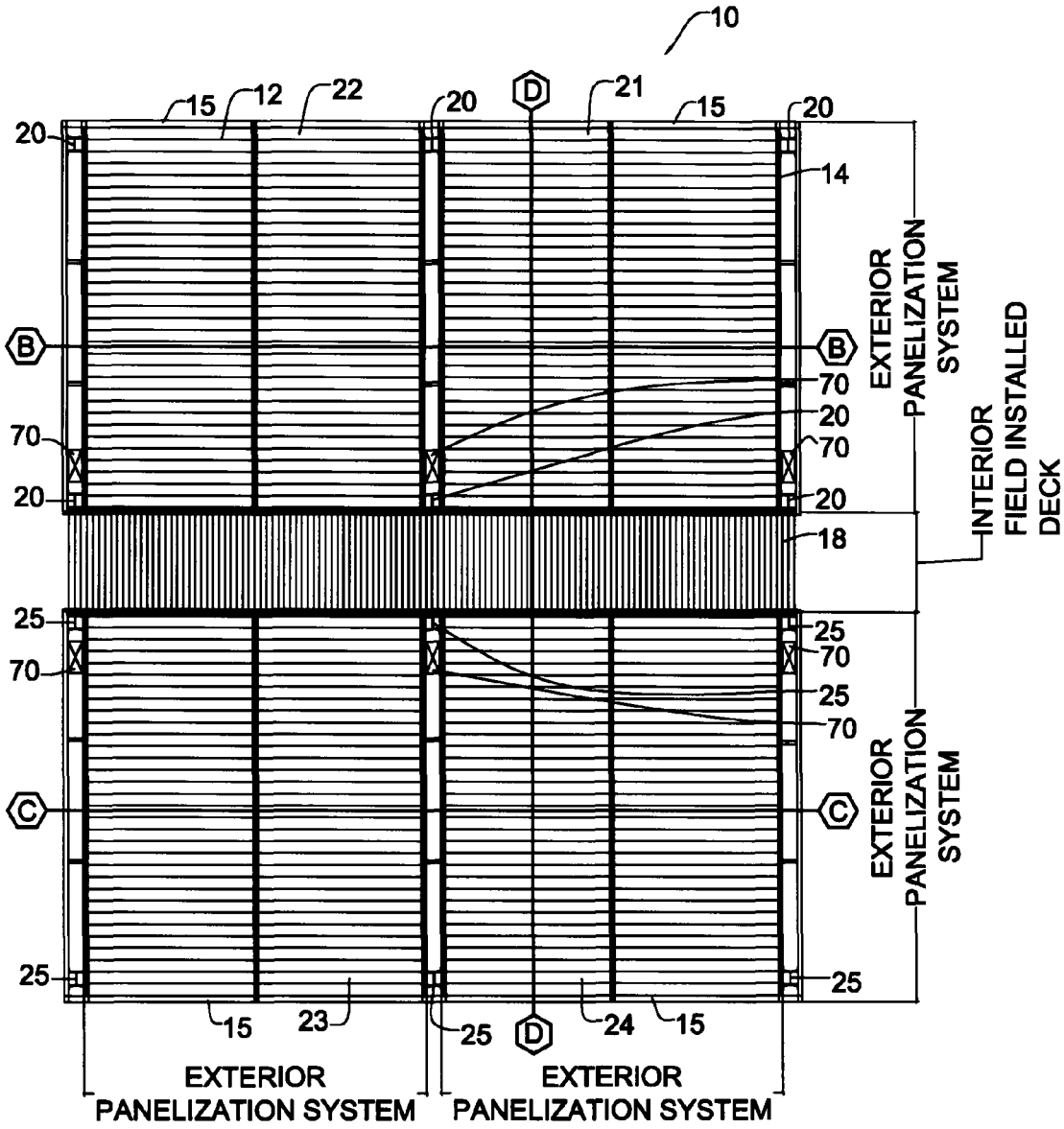
FIG. 1A is a plan view showing a plurality of exterior panelization systems and an interior field installed deck system, each having a frame component and a floor component according to a preferred embodiment of the present invention.
Figure 1B:
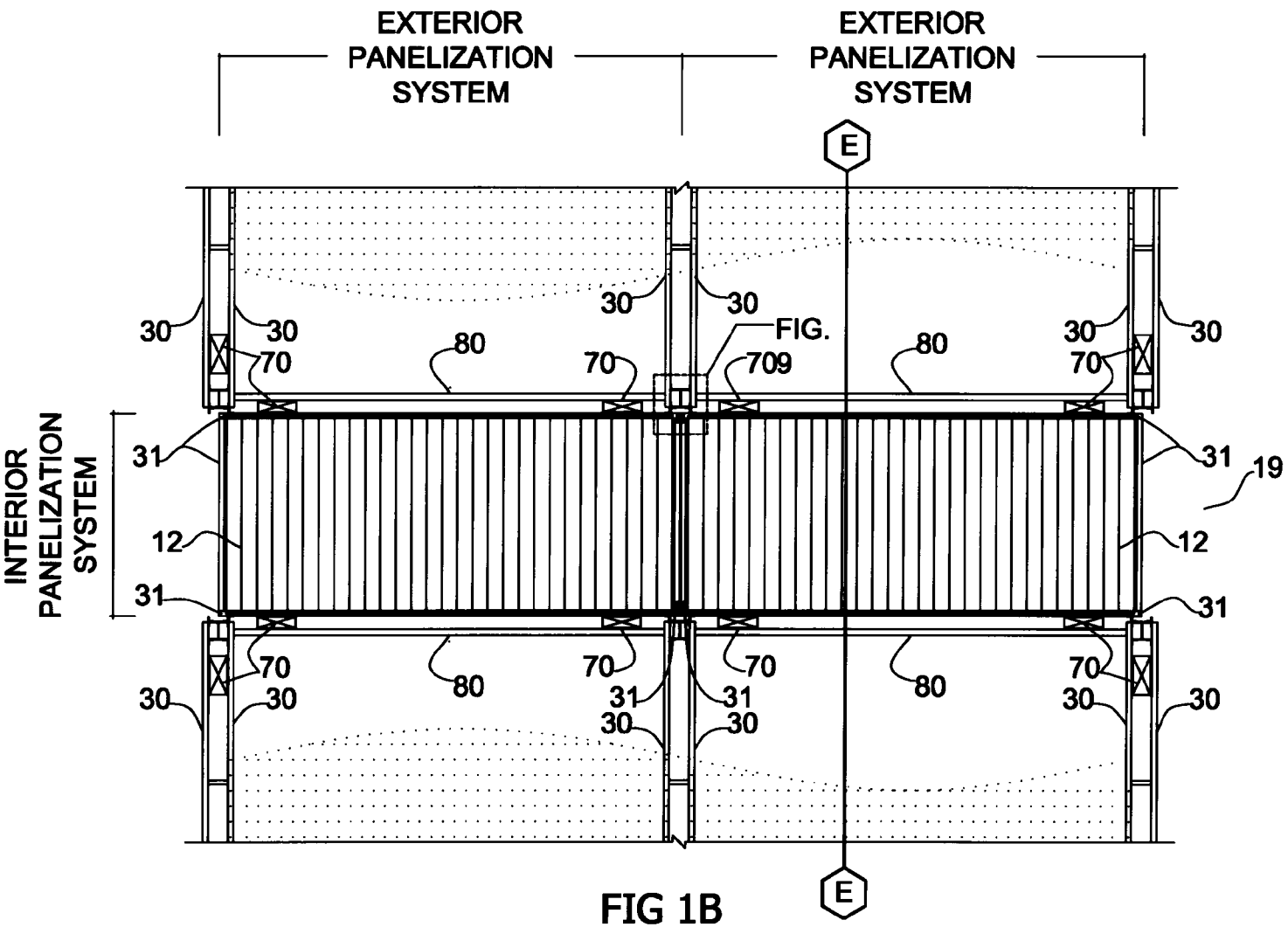
FIG. 1B is a plan view showing a plurality of interior panelization systems combined with a plurality of exterior panelization systems having a floor component and a frame component according to an alternative embodiment of the present invention.

The present invention includes a panelization system and method. As illustrated in the drawings, and in particular FIG. 1A, a panelization system that is an exterior panelization system 10 includes a floor component 12 and a frame component 14. This panelization system 10 can be incorporated within a variety of conventional constructions, which include a variety of conventional construction components. By way of example and not limitation, the panelization system 10 of the present invention is shown as being incorporated into a building having a plurality of vertical columns 20 and 25 that form the perimeters of a first, second, third and fourth zone 21, 22, 23, 24. As illustrated, the first and second zones 21, 22 share vertical columns 20, and the third and fourth zone 23, 24 share vertical columns 25. Additionally, the first and second zones 21, 22 are separated from the third and fourth zones 23, 24 by a field installed partition component 18, such as a deck section that can span to the perimeters of an interior space such as a corridor. Alternatively, an interior panelization system 19 can separate the first and second zones 21, 22, and from the third and fourth zones 23, 24, as shown in FIG. 1B.

Figure 2:
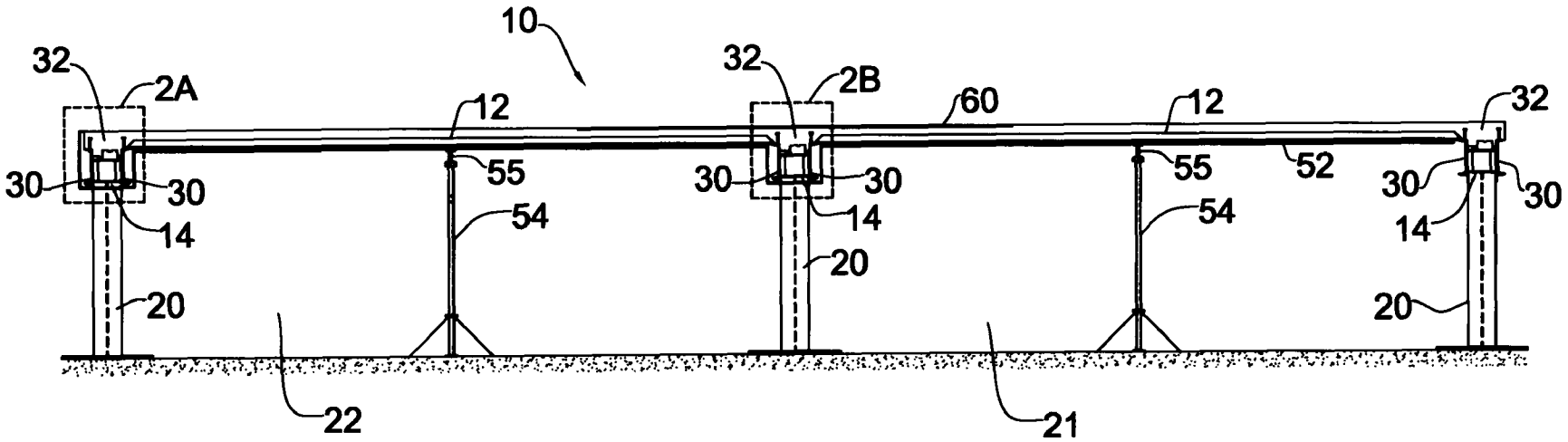
FIG. 2 is a cross sectional view taken at line B-B shown in FIG. 1A of an exterior panelization system having a frame component and floor component according to a preferred embodiment of the present invention.
Figure 2A:
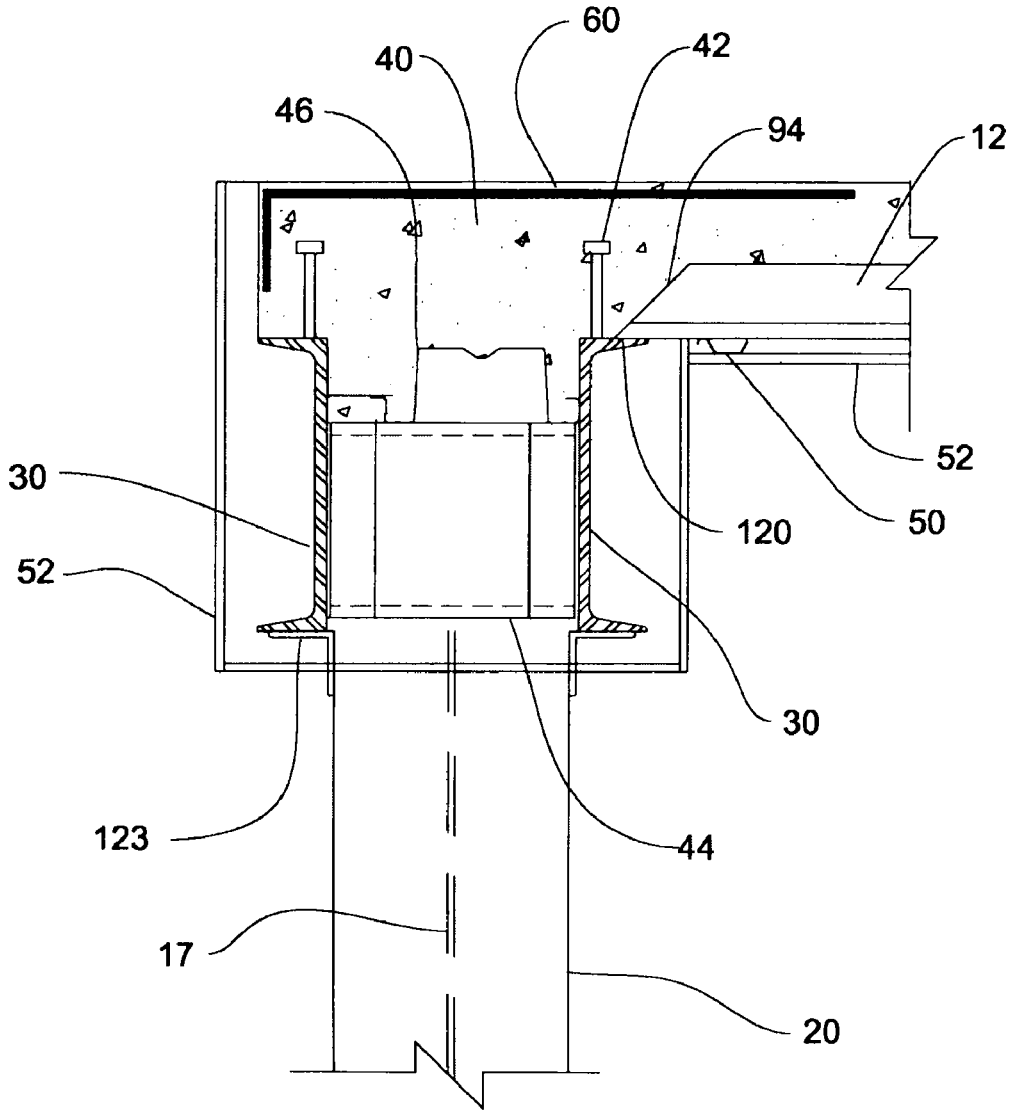
FIG. 2A is an enlarged cross sectional view taken at Section 2A shown in FIG. 2 of an exterior panelization system having a frame component and a floor component according to a preferred embodiment of the present invention.
Figure 2B:
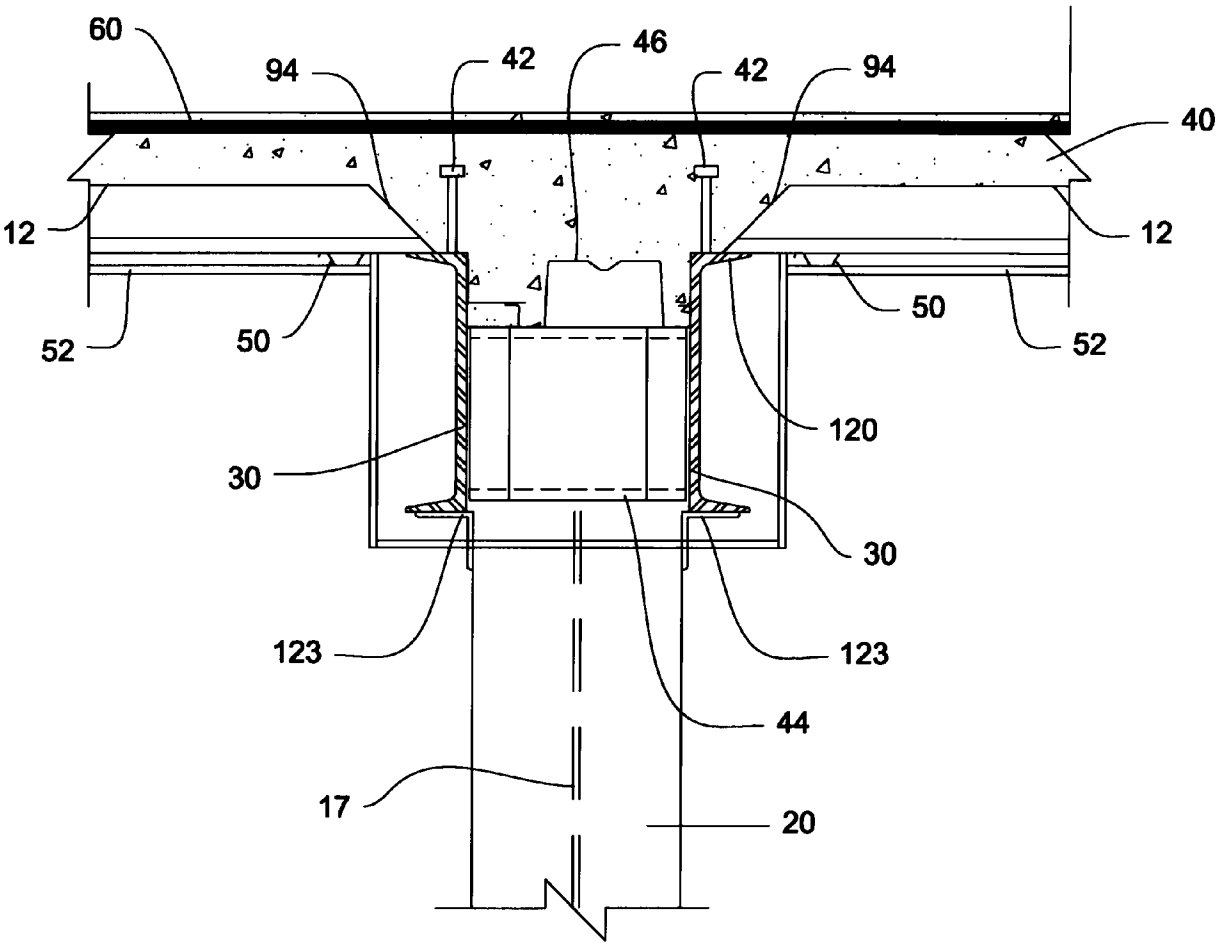
FIG. 2B is an enlarged cross sectional view taken at Section 2B shown in FIG. 2 of an exterior panelization system having a frame component and a floor component according to a preferred embodiment of the present invention.

A cross sectional view of the panelization system 10 as incorporated within the exemplary construction, and in particular, within the first and second zones 21, 22, is shown in FIG. 2 (Section B-B). Additionally, the areas of attachment of the panelization system 10 are shown as enlarged in FIGS. 2A and 2B. As illustrated, the frame component 14 of the panelization system 10 is connected to the vertical columns 20. Specifically, the frame component 14 includes horizontal beam elements 30 that are attached on opposing sides of each vertical column 20. Generally, the beam elements 30 are dimensioned to support the floor component 12 of the panelization system 10. In particular, the beam elements 30 can include a top flange 120 that support the ends 94 of the floor component 12. As further shown, the use of beam elements 30 on either side of the vertical columns 20 creates spacing 32 between the beam elements 30 along the centerline 17 of the vertical columns 20.

As previously described, a feature of the present invention includes the use of a frame component 14 that employs the use of horizontal beam elements 30 that are connected to vertical columns 20 or 25. Traditional systems use I-beams that are centered and span between vertical columns to provide support to floor components 12. Because of the shape of I-beams, the attachment of the beams between two columns eliminates the space 32 between the vertical columns. By using beam elements 30 that are connected to either side of a four-sided column, additional space 32 is provided between the vertical columns. This space 32 forms a voided air space that can create flexibility and be designed to allow for the vertical passage of other building trade components such as mechanical components, electrical components, etc., between floors.

By way of example and not limitation, a pourable, continuous layer of concrete 40 can be placed over the floor component 12 and within the confines of the frame component 14 to further complete the construction of the building floor. Accordingly, the frame component 14 optionally includes studs 42 extending into the concrete layer that can assist in the bonding and anchoring of the concrete to the beam elements. Furthermore, because the beam elements 30 create an open space 32 between the opposing vertical columns 20 supporting the floor component 12, a beam closure 46 can be connected to the opposing beam elements 30 to allow for the placing of a continuous layer of concrete 40. The beam closure 46 adjusts horizontally to abut beam elements 30 and seal the open space 32 during placement of the concrete 40. Additionally, a blocking 44 can be connected to opposing beam elements 30 so as to stabilize beam element 30 and provide bearing and support of beam closure 46.

The beam closure 46 can be any geometric shape, and can include a deck profile, panel, etc., attached between the beam elements 30 and atop the blocking 44 to restrict the flow of concrete 40 and seal the floor system from concrete leakage. Additionally, blocking 44 can be connected to opposing beam elements 30 so as to provide additional attachment between the beam elements 30 as needed to complete the construction. The blocking 44 can be any component installed between beam elements 30 to meet the design requirements. The continuous layer of concrete 40, can be further reinforced with the use of concrete reinforcing steel 60 such as steel sheets, bars, strips, plates, etc., that is designed and placed as needed in the flooring.

Again, by way of example and not limitation, the ceiling of the building can be formed by including furring channels 50 and gypsum board 52 attached beneath the panelization system 10. Additionally, during the construction process, temporary shoring posts 54 and beams 55 can be placed beneath the floor component 12 as shown in FIG. 2.

Figure 3:
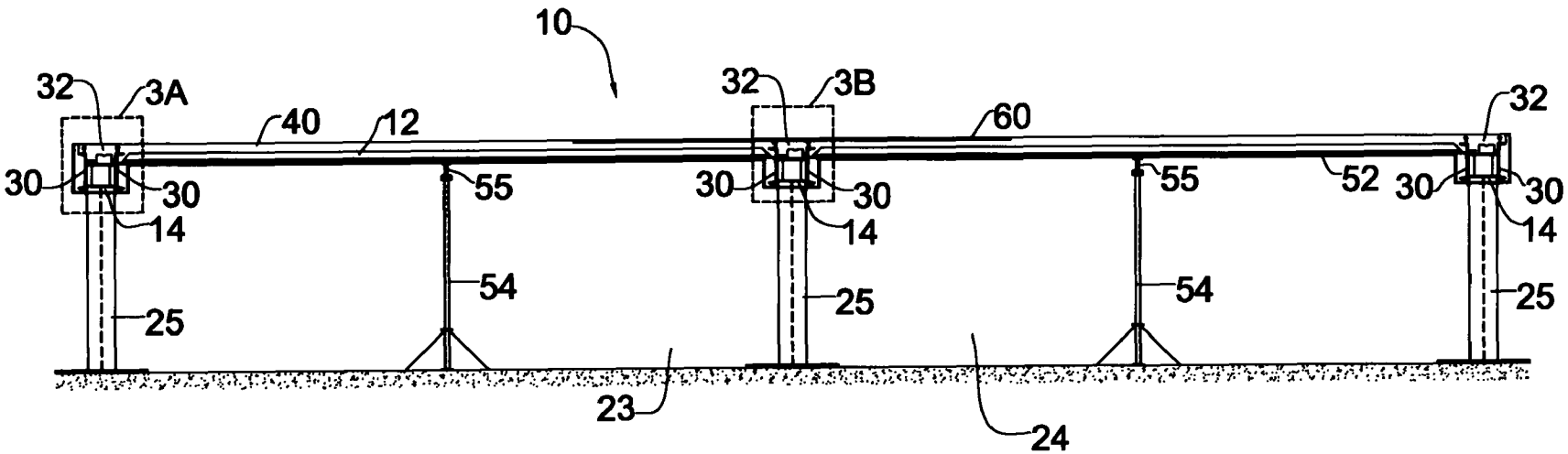
FIG. 3 is a cross sectional view taken at line C-C shown in FIG. 1A of an exterior panelization system having a floor component and frame component according to an alternative embodiment of the present invention.
Figure 3A:
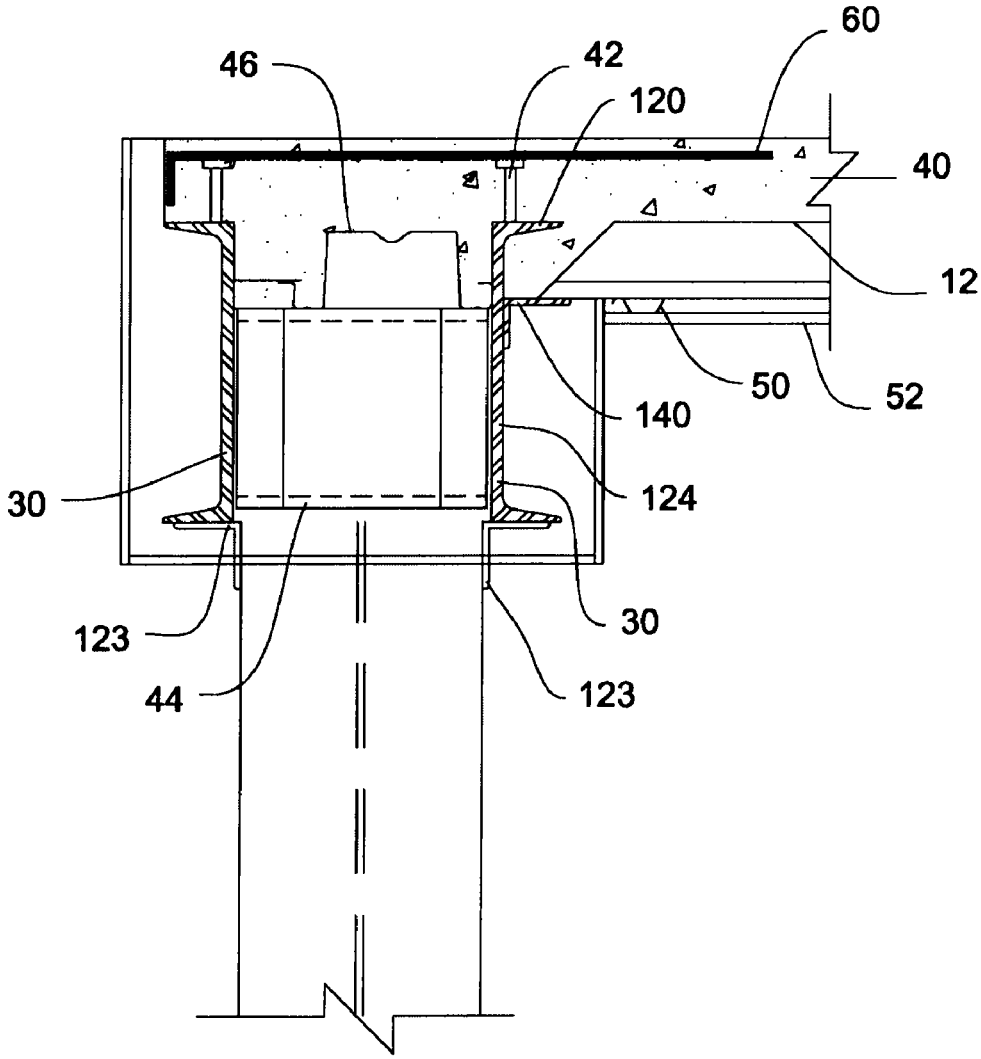
FIG. 3A is an enlarged cross sectional view taken at Section 3A shown in FIG. 3 of an exterior panelization system having a frame component and a floor component according to an alternate to the preferred embodiment of the present invention.
Figure 3B:
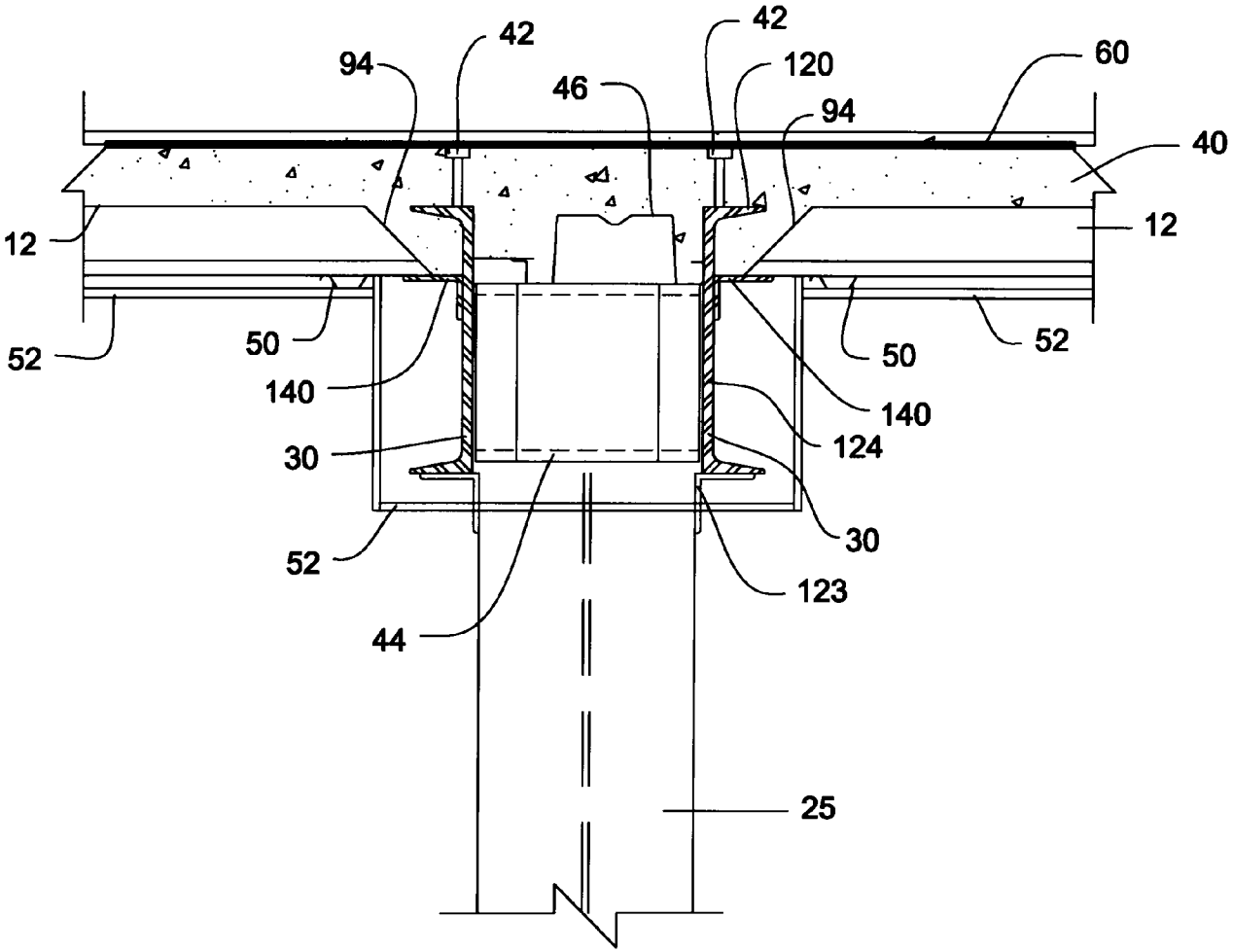
FIG. 3B is an enlarged cross sectional view taken at Section 3B shown in FIG. 3 of an exterior panelization system having a frame component and a floor component according to an alternative embodiment of the present invention.

An alternative embodiment of the frame component 14 is shown in FIG. 3 (Section C-C). Additionally, the areas of attachment of the panelization system 10 are shown enlarged in FIGS. 3A and 3B. As illustrated, in addition to the previously described features of the horizontal beam elements 30, the alternative embodiment includes a ledger angle 140 that is connected to the attachment surface 124 of the beam element 30. Rather than be supported by and connected to the top flange 120 of the beam element 30, therefore, the ends 94 of the floor component 12 can instead be supported by the ledger angle 140. This reduces the depth of the floor structure, thus providing flexibility in designing the floor to ceiling height of a multi-story building.

Figure 4:
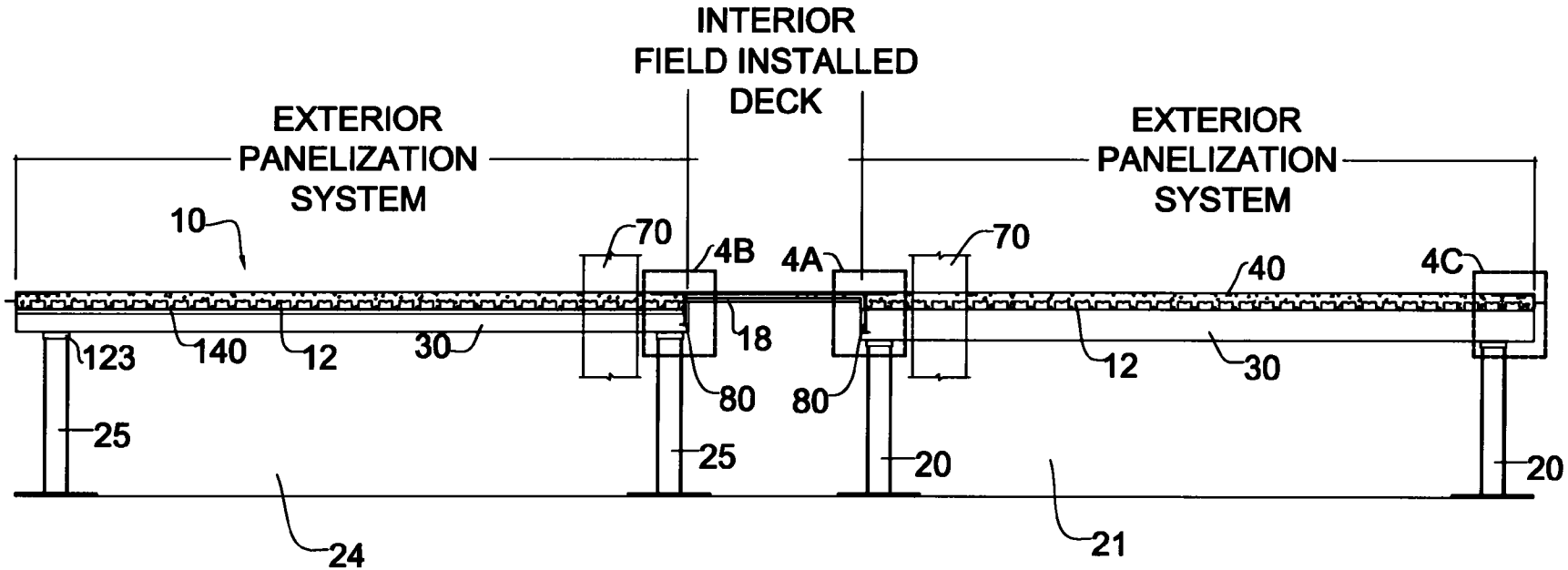
FIG. 4 is a cross sectional view taken at line D-D shown in FIG. 1A of an exterior panelization system having a frame component and floor component, and an interior field installed deck system according to a preferred embodiment of the present invention.

A cross sectional view of the panelization system 10 as incorporated within the exemplary construction, and in particular, within the first and fourth zones 21, 24, is shown in FIG. 4 (Section D-D). The connection between the floor component 12 and the partition component 18 is shown in detail in FIG. 4A. As previously discussed, the partition component 18 can be used to span an interior space such as a corridor of a building. The interior beam element 80 includes a top flange 81 that can serve to support the floor component 12. Additionally, a bent plate 82 can be attached to the top flange 81. This plate 82, which can be attached by welding, serves to support the partition component 18. Although a variety of shapes and dimensions can be employed, the interior beam element 80 can be any shape, and the bent plate 82 can be L-shaped.

The present invention also includes a spandrel beam system 15 used in connection with the panelization system 10. By way of example and not limitation, a plan view of a panelization system 10 incorporating the spandrel beam system 15 is shown in FIG. 1A. As shown, the spandrel beam system 15 is installed along the exterior edges of the panelization system 10.

Figure 4A:
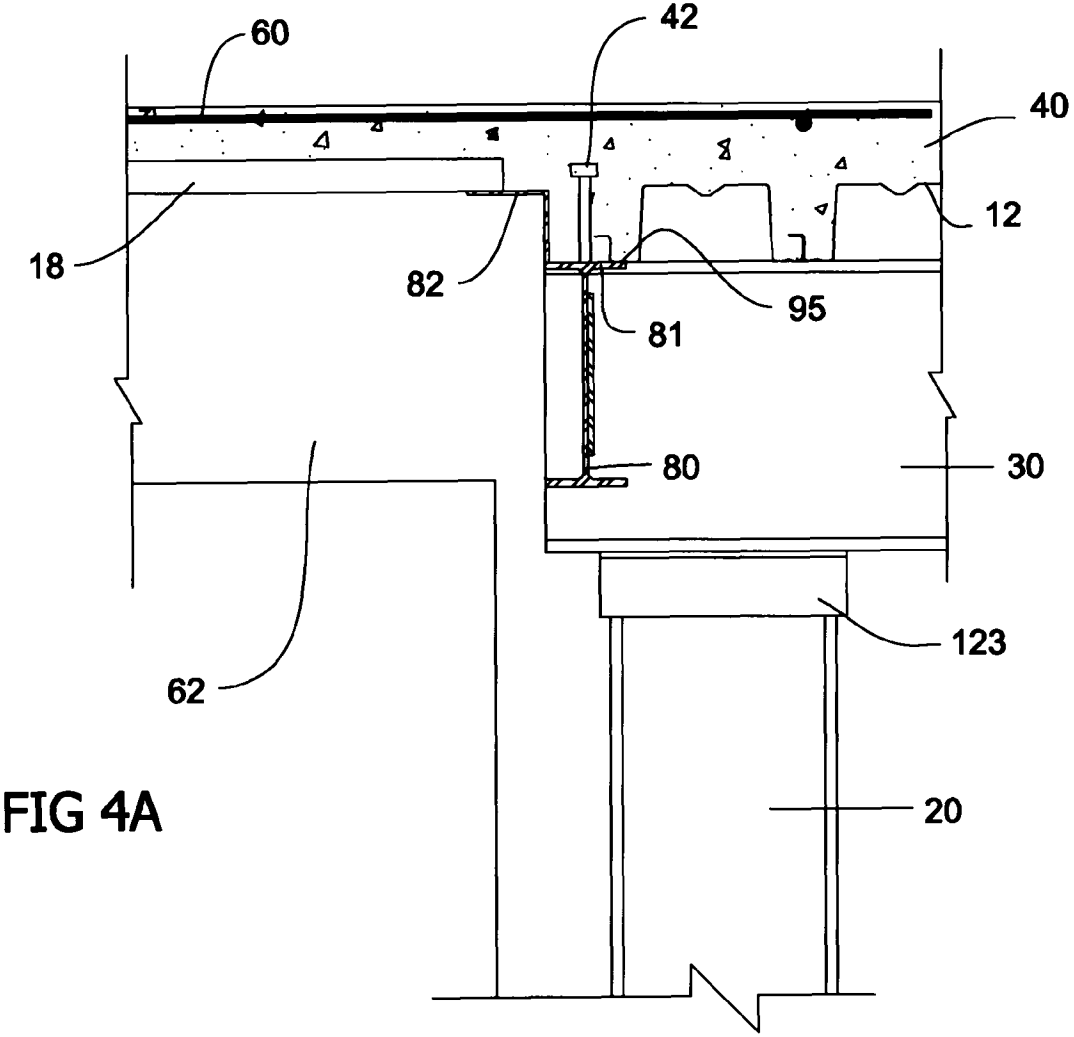
FIG. 4A is an enlarged cross sectional view taken at Section 4A shown in FIG. 4 of an interior field installed deck system having a frame component and a floor component according to a preferred embodiment of the present invention.
Figure 4B:
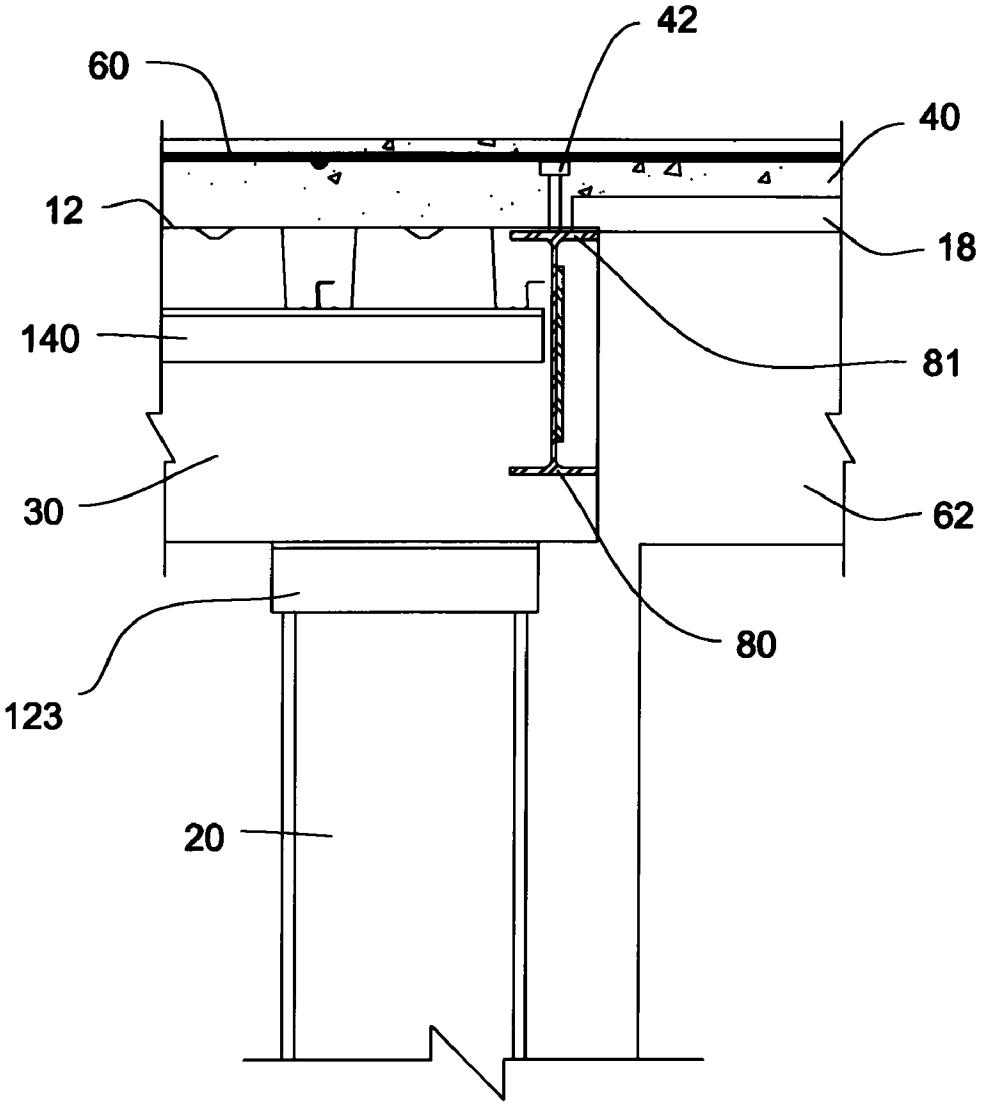
FIG. 4B is an enlarged cross sectional view taken at Section 4B shown in FIG. 4 of an interior field installed deck system having a frame component and a floor component according to an alternative embodiment of the present invention.
Figure 4C:
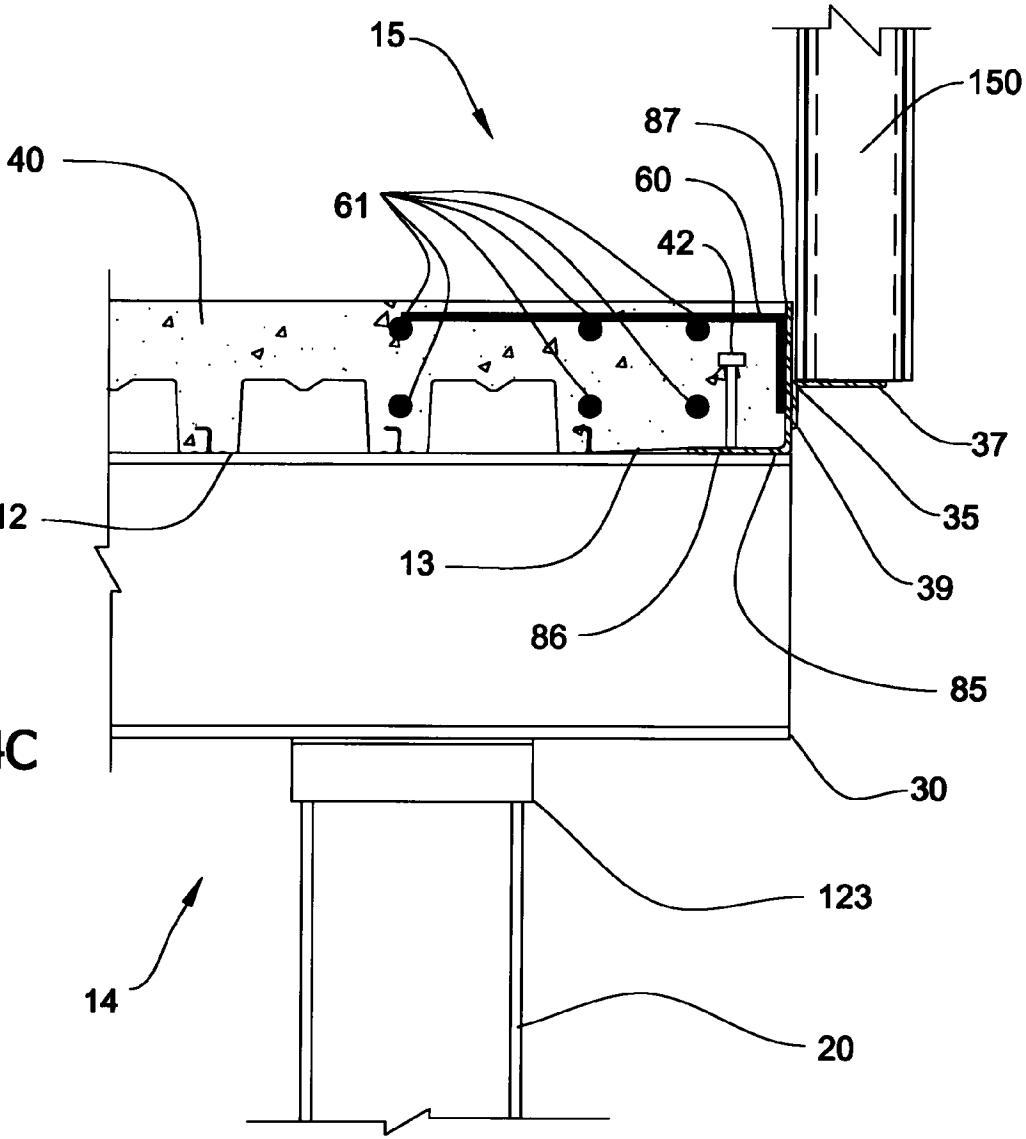
FIG. 4C is an enlarged cross sectional view taken at Section 4C shown in FIG. 4 of a cross sectional view of a spandrel beam system according to a preferred embodiment of the present invention.

The features of the spandrel beam system 15 are shown in detail in FIG. 4C. As illustrated, the spandrel beam system 15 includes floor component 12, a reinforcement means, such as continuous concrete reinforcing steel 61, a slab closure element 13, a continuous pour stop member 85, an optional shear stud 42, and a layer of concrete 40. In particular, the floor component 12 is primarily supported by the frame component 14 of the construction, which includes horizontal beam elements 30 and vertical columns 20 or 25 in the exemplary embodiment. The components of the spandrel beam system 15 are connected through mechanical means such as, welding and a continuous layer of concrete 40. Additionally, continuous concrete reinforcing steel 61 provides both bending and diaphragm shear resistance, along the spandrel beam system 15. Optionally, a plurality of hooked rebar 60 can also be used in combination with the other reinforcing features of the spandrel beam system 15 to support other vertical and horizontal loads.

A feature of the present invention includes the use of a continuous pour stop member 85 in combination with reinforcing means, including reinforcing steel 60 and rebar 61. This feature provides both positive and negative moment reinforcement, as well as diaphragm shear resistance, along the spandrel beam 15 of the panelization system 10.

As shown, the spandrel beam system 15 provides support for an exterior fascia element 150. Although other shapes and dimensions may be employed, the preferred embodiment of the spandrel beam system 15 includes an exterior fascia support, such as a ledger angle 35, that extends longitudinally along the length of the exterior fascia element 150. As illustrated, the support ledger angle 35 includes a first flange 37 and a second flange 39. Although various shapes are contemplated, the first flange 37 can be about perpendicular with the second flange 39. The first flange 37 provides a support for the exterior fascia element 150, and the second flange 39, which is adjacent to pour stop 85, provides an area of attachment to the pour stop 85. The means of supporting the exterior fascia element 150 can be completed through other designs.

Similarly, the pour stop 85 includes a first flange 87 and a second flange 86. Although various shapes are contemplated, the first flange 87 of pour stop 85 can be about perpendicular with the second flange 86. The first flange 87 of pour stop 85 is adjacent to the second flange 39 of the exterior fascia support angle 35. Furthermore, the first flange 87 of pour stop 85 establishes the boundaries of the layer of concrete 40 and prevents the layer of concrete 40 from making contact with the exterior fascia elements 150. Additionally, the first flange 87 can be used as an attachment surface for hooked reinforcing steel 60. As shown, the second flange 86 of the pour stop 85 can as an option include shear stud 42 or multiple shear studs (not shown) extending into the layer of concrete 40 that can assist in the bonding and anchoring of the layer of concrete 40 to spandrel beam system 15. The slab closure element 13, which can be any shape, including a flat strip, is used to provide connection between the pour stop 85 and the outermost section of the floor component 12. Other profile shapes can be used instead of the pour stop angle 85 described above depending on the design requirements (i.e channel shapes).

Figure 5:
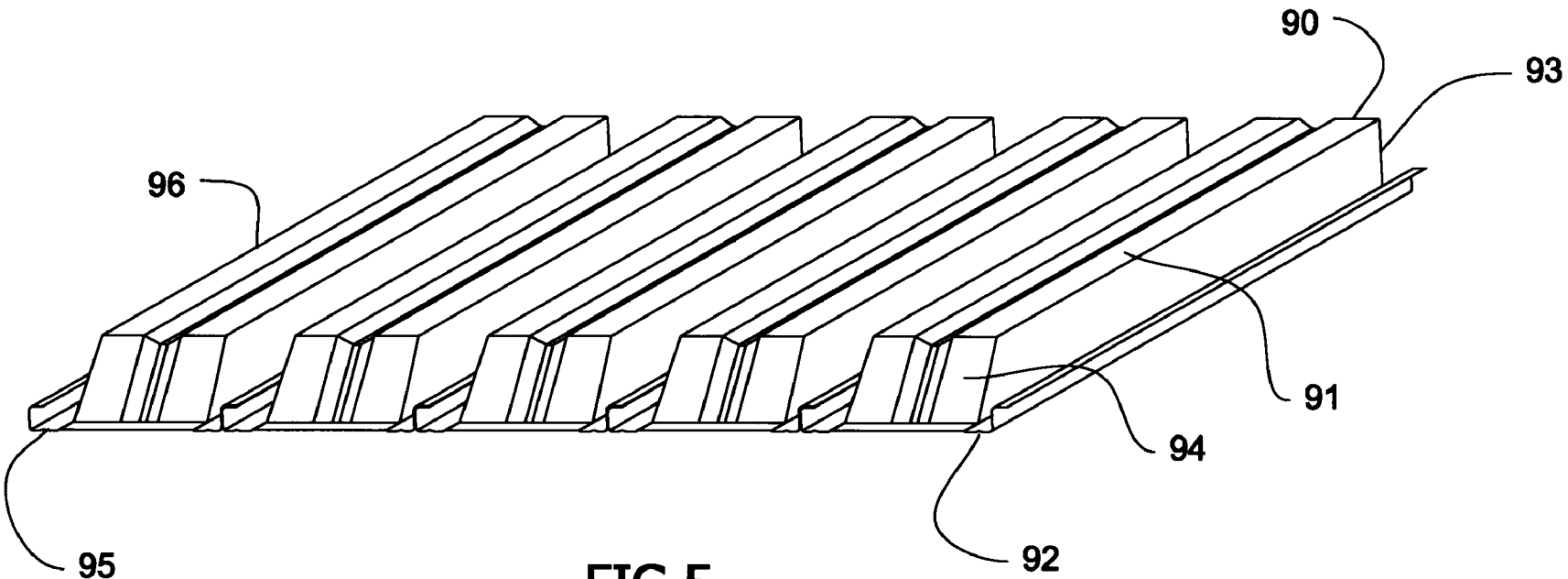
FIG. 5 is a perspective view of a floor component of a panelization system according to a preferred embodiment of the present invention.

By way of example and not limitation, a feature that can be included in both a suitable floor component 12 and partition component 18 is shown in FIG. 5. As illustrated, both the floor component 12 and partition component 18 includes a deck member 90. Although numerous shapes and dimensions are contemplated by the present invention, the deck member 90 can have longitudinally extending channels that can be formed by parallel, alternately positioned flats (bottom flange members) 92 and ribs (top flange members) 91 that are connected by side walls (vertical web members) 93. In particular, the deck member 90 can be made of metal. Depending on the length and width required for the floor component 12, deck members 90 can be made of continuous panels that cover the desired width and length, or deck members 90 can be made of sections that are combined in juxtaposed relation to form the desired width and length. In the exemplary embodiment, the deck member 90 includes multiple, adjacent deck sections that are joined along their respective flats 92. Preferably, the deck member 90 includes deck sections having closed ends 94. Although either, one, both or none, of the deck section ends can be closed, or not, only one end of the deck sections is shown in FIG. 5.

The deck member 90 can be used to connect the floor component 12 to the frame component 14 of the present invention. As illustrated in FIGS. 2A, 2B, 3A and 3B, the floor component 12 is attached to the frame component 14, such as by welding, along the alternately positioned flats (bottom flange members) 92 of the deck sections. Accordingly, the floor component 12 is preferably attached to the interior beam 80 along an outermost flat 95 of an outermost deck section 96 of the deck member 90, as shown in FIG. 4A.

An exemplary attachment of the partition component 18 to the frame component 14 of the present invention is shown in FIGS. 4A and 4B. The partition component 18 can be connected to the interior beam element 80 by way of the top flange 81 or by the bent plate 82 along the alternately positioned flats 92 of the deck section.

Figure 6:
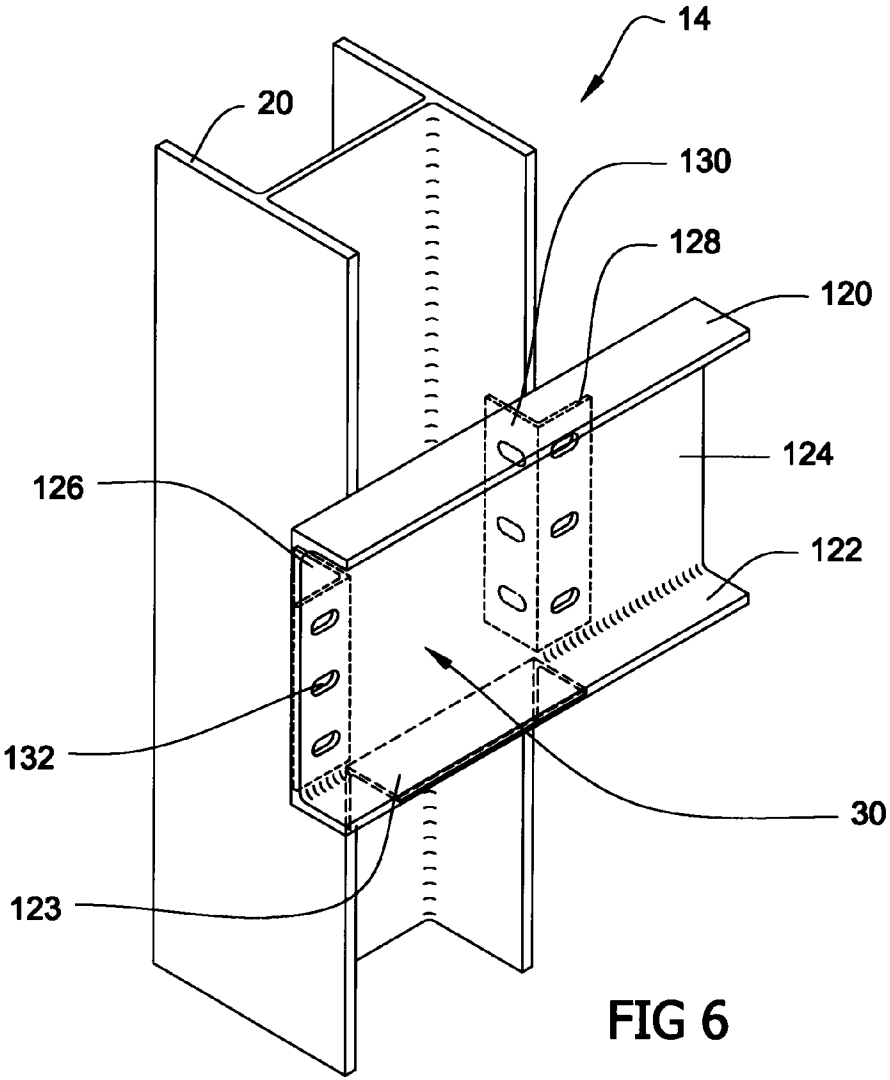
FIG. 6 is perspective view of a frame component of a panelization system according to a preferred embodiment of the present invention.

FIG. 6 illustrates the particular features of the frame component 14 of the present invention. By way of example and not limitation, the horizontal beam element 30 of the frame component 14 is C-shaped, and includes a top flange 120, a bottom flange 122, and an attachment surface 124. Although a variety of attaching means can be employed to attach the beam element 30 to the vertical columns 20 or 25, a slotted clip angle 126 can be used that is generally L-shaped. The clip angle 126 includes a beam element attachment flange 128 that is specifically connected to the attachment surface 124 of the beam element 30, and a column attachment flange 130 that is specifically connected to the column 20 or 25. Depending on the shape of the column, the slotted clip angle 126 can be used on opposing sides of the column, assuming a four-sided column is employed. Furthermore, slots 132 are along both the beam element attachment flange 128 and the column attachment flange 130 to enable horizontal adjustment of the beam element 30. Optionally, the bottom flange 122 of the beam element 30 can be temporarily supported by a ledger angle 123 during the installation of the panelization system 10 before the beam elements 30 are connected to the columns 20 or 25.

Figure 7:
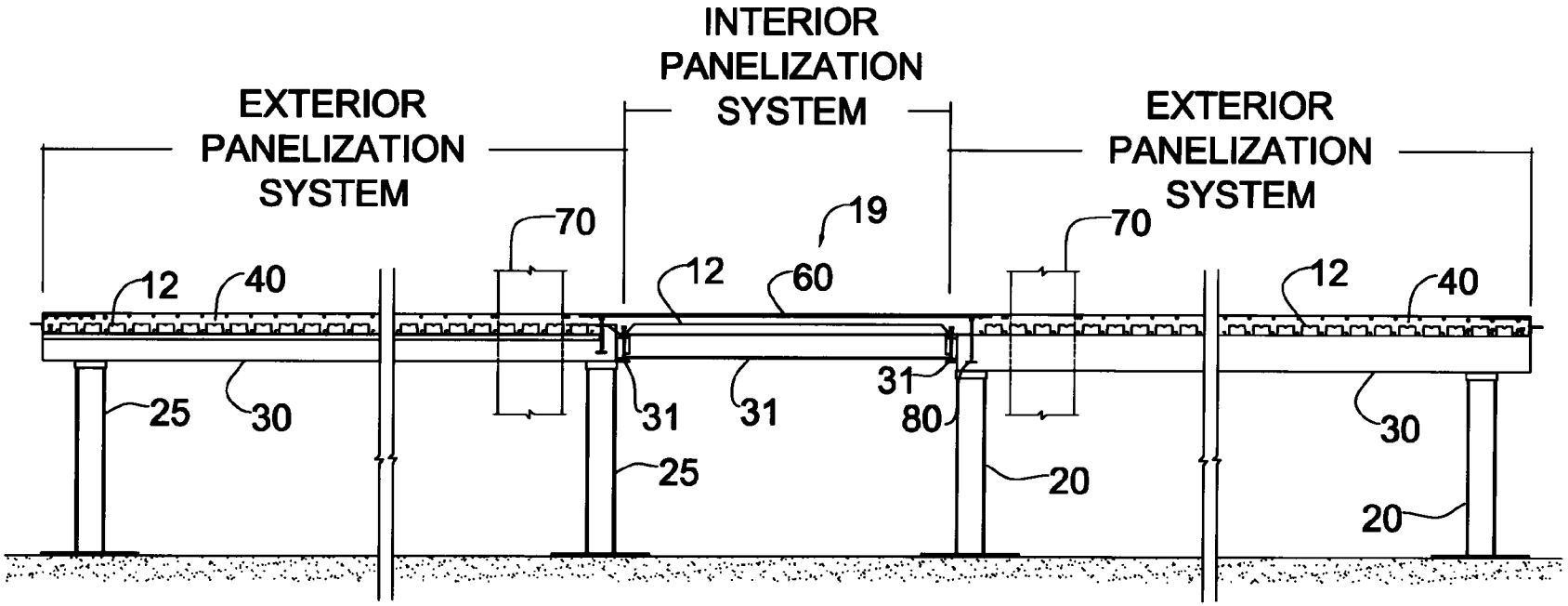
FIG. 7 is a cross sectional view taken at line E-E as shown in FIG. 1B of an interior panelization system according to an alternative embodiment of the present invention.
Figure 8:
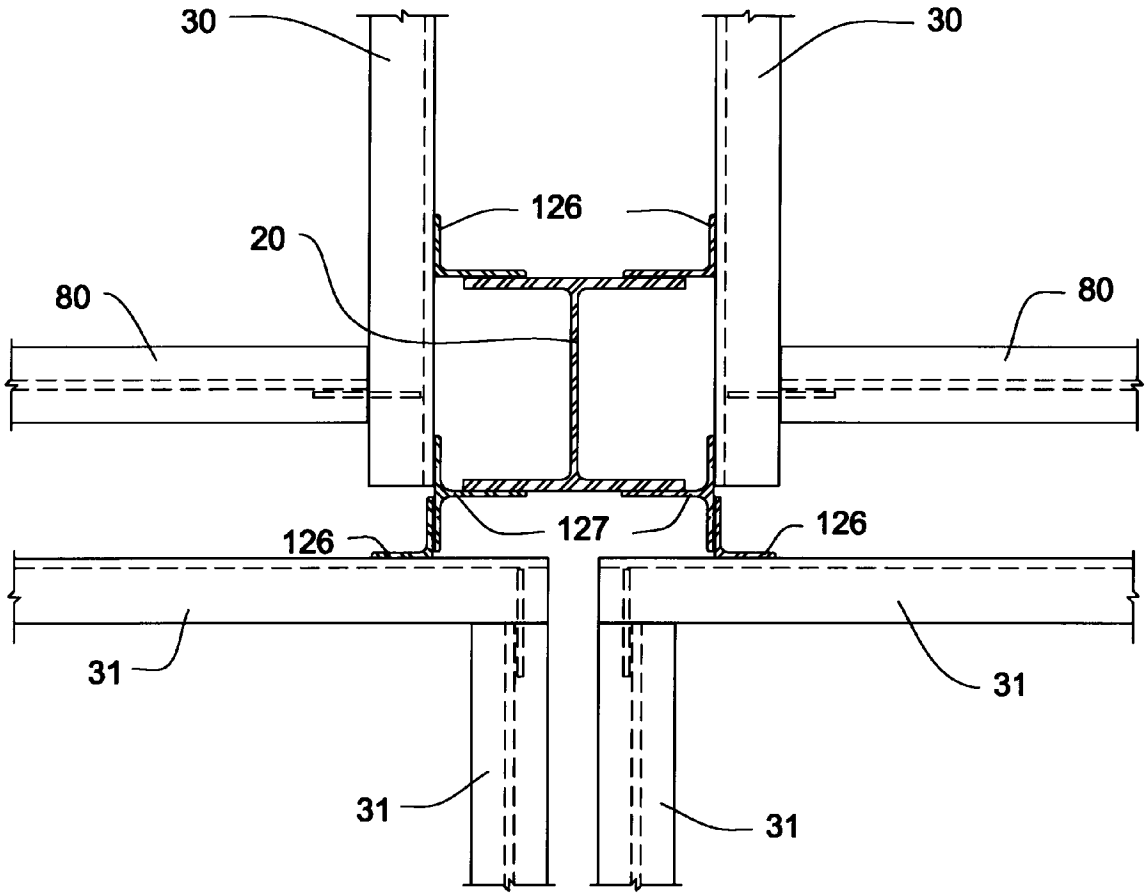
FIG. 8 is an enlarged plan view of the connection detail at the interior panelization system and column as shown in FIG. 1B according to an alternate embodiment of the present invention.

An alternative embodiment of the connection between adjacent exterior panelization systems 10 includes the use of an interior panelization system 19, as shown in FIGS. 1B and 7. As previously discussed, the interior space between panelization zones of a building can be a corridor of a building. The interior panelization system 19 includes a floor component 12 that is supported by beam elements 31, which is similar to the floor component 12 for the exterior panelization system 10 and the interior partition 18. The interior panelization system 19 is framed by beam elements 31 on four sides, as shown in FIG. 8. The floor components 12 are not shown so that the attachment of the beam elements 31 can be better illustrated. This frame formed by beam elements 31 is attached to vertical columns 20 or 25 by a series of slotted support angles 126 and shear connectors 127, shown in FIG. 8. Depending on the size and dimension of the interior space, a number of interior panelization systems 19 can be used. In the exemplary embodiment, shown in FIG. 1B, two adjacent interior panelization systems 19 are shown, each having a floor component and a frame component. A variety of shapes and dimensions can be employed for the slotted clip angles 126 and the shear connectors 127, including L-shape and T-shape, respectively. Additionally, a variety of shapes and dimensions can be employed for the interior beam elements 31.

Depending on the particular design of a building, a horizontal mechanical plenum 62 can be included beneath the partition component 18 or interior panelization system 19, as shown in FIGS. 4A and 4B. Additionally, the features of the panelization system 10 allow for the strategic placing of vertical mechanical openings between the centerlines of the vertical columns 20 and 25. An example of the location of these mechanical openings 70 is shown in FIGS. 1A and 1B.

The present invention further includes a method for constructing a floor using the panelization system 10. The steps of the method include: 1) providing vertical columns 20 or 25 that are spaced apart so as to establish perimeters in a building construction or room within a building construction; 2) providing the frame component 14 as previously described; 3) providing the floor component 12 as previously described; 4) connecting the frame component 14 and the floor component 12 to form the panelization system 10; 5) elevating the panelization system 10 and positioning the preassembled panelization system 10 between the vertical columns 20 or 25; 6) connecting the panelization system 10 to the vertical columns 20 or 25; and 7) forming the spandrel beam system 15 along exterior edges of building.

Those skilled in the art of panelization systems will recognize that many substitutions and modifications can be made in the foregoing preferred embodiments without departing from the spirit and scope of the present invention.

What is claimed is:

1. A method for constructing a floor or roof, comprising the steps of:

(a) providing two columns that are spaced apart, a first column of said two columns having opposing sides, a first clip angle, an opposing second clip angle, a first ledger angle on a first side of said opposing sides, and a second ledger angle on a second side of said opposing sides, and a second column of said two columns having opposing sides, a first clip angle, a second clip angle, a first ledger angle on a first side of said opposing sides, and a second ledger angle on a second side of said opposing sides, said first and second ledger angles of said first column being on opposing sides of said first column, said first and second ledger angles of said second column being on opposing sides of said second column;

(b) providing a first frame component composed of plural interconnected beams;

(c) providing a first floor component composed of plural interconnected deck units;

(d) connecting said first frame component and said first floor component to form a first panel;

(e) then positioning said first panel on said first ledger angle of said first column and said first ledger angle of said second column;

(f) then connecting said first panel to said first clip angle of said first column and said first clip angle of said second column;

(g) providing a second frame component composed of plural interconnected beams;

(h) providing a second floor component composed of plural interconnected deck units;

(i) then positioning said second panel on said second ledger angle of said first column and said second ledger angle of said second column whereby an open space is formed between said first and second panels between said first and second columns; and (k) then placing a layer of concrete on said first panel and said second panel.

2. The method as recited in claim 1, wherein said plural interconnected beams of said first frame component include at least one spandrel beam.

3. The method as recited in claim 1, further comprising the steps of:

(a) installing a blocking in said open space.

4. The method as recited in claim 1, further comprising the steps of:

(a) installing a blocking in said open space;

(b) installing a beam closure in said open space; and (c) pouring a layer of concrete over said beam closure.

5. A method for constructing a floor or roof for a building, said method comprising the steps of:

(a) erecting spaced-apart vertical columns, said vertical columns having vertical sides and vertical centerlines;

(b) then attaching ledger angles to said vertical sides of said vertical columns, each ledger angle of said ledger angles being attached to a single vertical column of said vertical columns;

(c) attaching clip angles to said vertical columns;

(d) connecting plural horizontal beams to form a frame component;

(e) connecting plural deck units to said frame component to form a panel, said panel having ends;

(f) then positioning said panel on said ledger angles of said vertical columns with said horizontal beams of said frame component supported on said ledger angles; and (g) attaching said panel to said clip angles of said vertical columns to provide a floor for said building whereby said panel is supported from said vertical sides of said vertical columns by said ledger angles.

6. The method as recited in claim 5, wherein one horizontal beam of said plural horizontal beams is a spandrel beam.

7. The method as recited in claim 6, wherein said spandrel beam is formed by the step of (a) installing a ledger angle as part of said spandrel beam to support building exterior fascia.

8. The method as recited in claim 6, wherein said spandrel beam is formed by the step of (a) installing a continuous concrete reinforcing steel as part of said spandrel beam to provide shear and bending resistance for said spandrel beam along said floor component.

9. The method as recited in claim 6, wherein said spandrel beam is formed by the step of (a) installing a continuous pour stop member as part of said spandrel beam.

10. The method as recited in claim 5, wherein said each ledger angle has a top flange and wherein said positioning step further comprises the step of (a) positioning said panel on said top flange of said each ledger angle.

11. The method as recited in claim 6, wherein said spandrel beam has the same depth as said floor component.

12. A method for constructing a floor or roof for a building, said building having plural, spaced-apart, vertical columns, each vertical column of said plural vertical columns having opposing vertical sides and vertical centerlines, said method comprising the steps of:

(a) attaching ledger angles to said vertical sides of said vertical columns, each ledger angle of said ledger angles being attached to a single vertical column;

(b) attaching clip angles to said vertical columns;

(c) forming frame components, each frame component being formed by connecting plural horizontal beams together;

(d) securing floor components to said frame components to form panels, each floor component being composed of plural connected decking units secured to one frame component to form one panel, said floor components having ends;

(e) then positioning said panels on said ledger angles of said vertical columns; and (f) then attaching said panels to said clip angles on said vertical columns thereby providing a floor of said building, said panels being supported on said ledger angles by said vertical sides of said vertical columns.

13. The method as recited in claim 12, wherein said step of attaching said panels further comprises the step of (a) attaching said panels to said vertical columns so that said panels leave spaces along said centerlines of said vertical columns and between said panels.

14. The method as recited in claim 12, wherein said step of attaching said ledger angles further comprises the step of (a) attaching said ledger angles to said sides of said columns at an elevation, and wherein said positioning step further comprises the step of (b) lifting said each panel to said elevation.

15. A method for constructing a floor or roof for a building, said method comprising the steps of:

(a) providing plural, spaced-apart, vertical columns, each vertical column of said plural vertical columns having opposing vertical sides and vertical centerlines, said columns carrying ledger angles;

(b) then attaching clip angles to said opposing vertical sides of said vertical columns, at least one clip angle being attached to said each vertical column, said clip angles being attached at an elevation on said vertical columns;

(c) forming plural frame components by connecting plural horizontal beams together;

(d) forming plural floor components by connected plural deck units together;

(e) securing said plural floor components to said plural frame components to form plural panels, each floor component of said plural floor components being secured to one frame component of the plural frame components to provide one panel of said plural panels, each panel of said plural panels having ends;

(e) then lifting said each panel;

(f) then positioning said each panel on said ledger angles of said vertical columns; and (g) then attaching said each panel to said clip angles of said vertical columns, forming spaces between adjacent panels of said plural panels along said centerlines of said vertical columns and between said frame components of said panels.

16. A method for constructing a floor or roof for a building, said method comprising the steps of:

(a) providing two spaced-apart, vertical columns, each vertical column of said two vertical columns having opposing vertical sides and vertical centerlines;

(b) then attaching clip angles to said opposing vertical sides of said two vertical columns, at least one clip angle being attached to said each vertical column, said clip angles being attached at an elevation on said vertical columns;

(c) forming two frame components, each frame component of said two frame components being formed by connecting plural horizontal beams together;

(d) securing two floor components to said two frame components to form two panels, each floor component of said two floor components being composed of plural interconnected deck units secured to one frame component of said two frame components to provide one panel of said two panels; and (e) then attaching said each panel of said two panels to said clip angles on said two vertical columns, one panel to said clip angles on a first side of said two columns and a second panel to said clip angles on an opposing side of said two columns so that a space remains between said two panels along said centerlines of said vertical columns and between said two panels.

* * * * *